US005612505A

United States Patent [19]

O'Brasky et al.

[11] Patent Number: 5,612,505

[45] Date of Patent: Mar. 18, 1997

[54] DUAL MODE WARHEAD

[75] Inventors: James S. O'Brasky, King George County, Va.; Alan A. Alexander, Minnetonka, Minn.; Odis H. Griffin, Jr., Mogadore, Ohio; John S. Foster, Fredericksburg, Va.; Morley C. Shamblen, La Plata, Md.

[73] Assignee: The United States of America as represented by the Secretary of the Navy, Washington, D.C.

[21] Appl. No.: 181,303

[22] Filed: Aug. 25, 1980

[51] Int. Cl.[6] ..... F42C 9/14; F42B 12/22

[52] U.S. Cl. ..... 102/268; 102/276; 102/310; 102/320; 102/378; 102/494; 102/506

[58] Field of Search ..... 102/267, 268, 102/271, 276, 310, 318, 320, 377, 378, 478, 494, 506

[56] References Cited

U.S. PATENT DOCUMENTS

| | | | |
|---|---|---|---|
| 911,792 | 2/1909 | Wieser | 102/271 |
| 2,231,581 | 2/1941 | Junghans | 102/268 X |
| 2,709,963 | 6/1955 | Butterworth | 102/276 |
| 3,018,734 | 1/1962 | Eggman | 102/276 X |
| 3,717,095 | 2/1973 | Vann | 102/320 |
| 3,786,754 | 1/1974 | Donahue et al. | 102/268 X |
| 3,977,327 | 8/1976 | Brumfield et al. | 102/494 |
| 4,096,802 | 6/1978 | Waln | 102/378 |
| 4,178,854 | 12/1979 | Schillreff | 102/377 |
| 4,230,042 | 10/1980 | Popovitch | 102/271 |
| 4,233,673 | 11/1980 | Cricchi et al. | 102/276 X |

*Primary Examiner*—Peter A. Nelson
*Attorney, Agent, or Firm*—James B. Bechtel, Esq.

[57] ABSTRACT

A dual mode warhead is provided for use against both soft and hard targets and capable of sensing which type of target has been struck comprising a casing made of a ductile material containing an explosive charge and a fuze assembly. The ductile warhead casing will mushroom and later split upon striking a hard target while still confining the explosive. Proper ductility and confinement are necessary for fuze sensing. The fuze assembly contains a pair of parallel firing trains, one initiated only by high and one by low impact deceleration. The firing train actuated by low impact deceleration contains a pyrotechnic delay to allow penetration of soft targets.

7 Claims, 2 Drawing Sheets

DUAL MODE WARHEAD

BACKGROUND OF THE INVENTION

1. Field of the Invention

This invention relates generally to projectile and missile warheads, and more particularly to a dual mode warhead which may be used to defeat a range of infantry targets which previously required different warheads for defeat.

2. Description of the Prior Art

In the past there has been no single warhead small enough to be man-portable and shoulder-launched which was capable of defeating both soft targets such as sandbag-timber or sandbag-concrete bunkers and hard targets such as masonry or reinforced concrete bunkers. Several different warhead types were needed to defeat such a target spectrum. A man-portable, hard target warhead striking a sandbag-timber or sandbag-concrete bunker would detonate on the surface and simply blow a lot of sand about. On the other hand, a soft target warhead containing a pyrotechnic delay to allow penetration, would fragment or rupture before the delay had timed out upon striking a hard target thereby releasing some explosive and reducing its effectiveness. It would therefore be highly desirable to provide a single warhead, operable in two modes, and effective against both soft and hard targets.

SUMMARY OF THE INVENTION

The present invention obviates the aforementioned disadvantages by providing a dual mode warhead effective against the spectrum of infantry targets. The warhead comprises a casing made of a ductile material containing a malleable yet structurally-stiff explosive charge and a fuze assembly and booster. The fuze assembly contains, in addition to the usual safing and arming mechanism, a pair of parallel firing trains initiated by the shock of the impact decelerations. One of these firing trains is responsive to low impact decelerations and incorporates therein a pyrotechnic delay to enable substantial penetration of soft targets. The other firing train is designed to be responsive only to the high impact decelerations encountered when striking hard targets. The structural stiffness of the explosive charge facilitates transmittal of the deceleration forces of the fuzing assembly and the ductility of the casing enables the casing to confine the explosive while mushrooming upon impact with the hard target until the explosive is detonated.

STATEMENT OF THE OBJECTS OF THE INVENTION

It is a primary object of this invention to provide a warhead which may be used to defeat a wide range of infantry targets.

It is another object of this invention to provide a dual mode warhead which is effective against both soft and hard targets.

It is a further object of this invention to provide a dual mode warhead capable of sensing whether it has struck a soft or hard target and then functioning accordingly.

It is yet another object of this invention to provide a dual mode warhead which may be employed in projectiles as well as various types of missiles,

BRIEF DESCRIPTION OF THE DRAWINGS

Other objects, advantages and novel features of the invention will become readily apparent upon consideration of the following detailed description when read in conjunction with the accompanying drawings wherein.

DESCRIPTION OF THE PREFERRED EMBODIMENT

Figure 1:
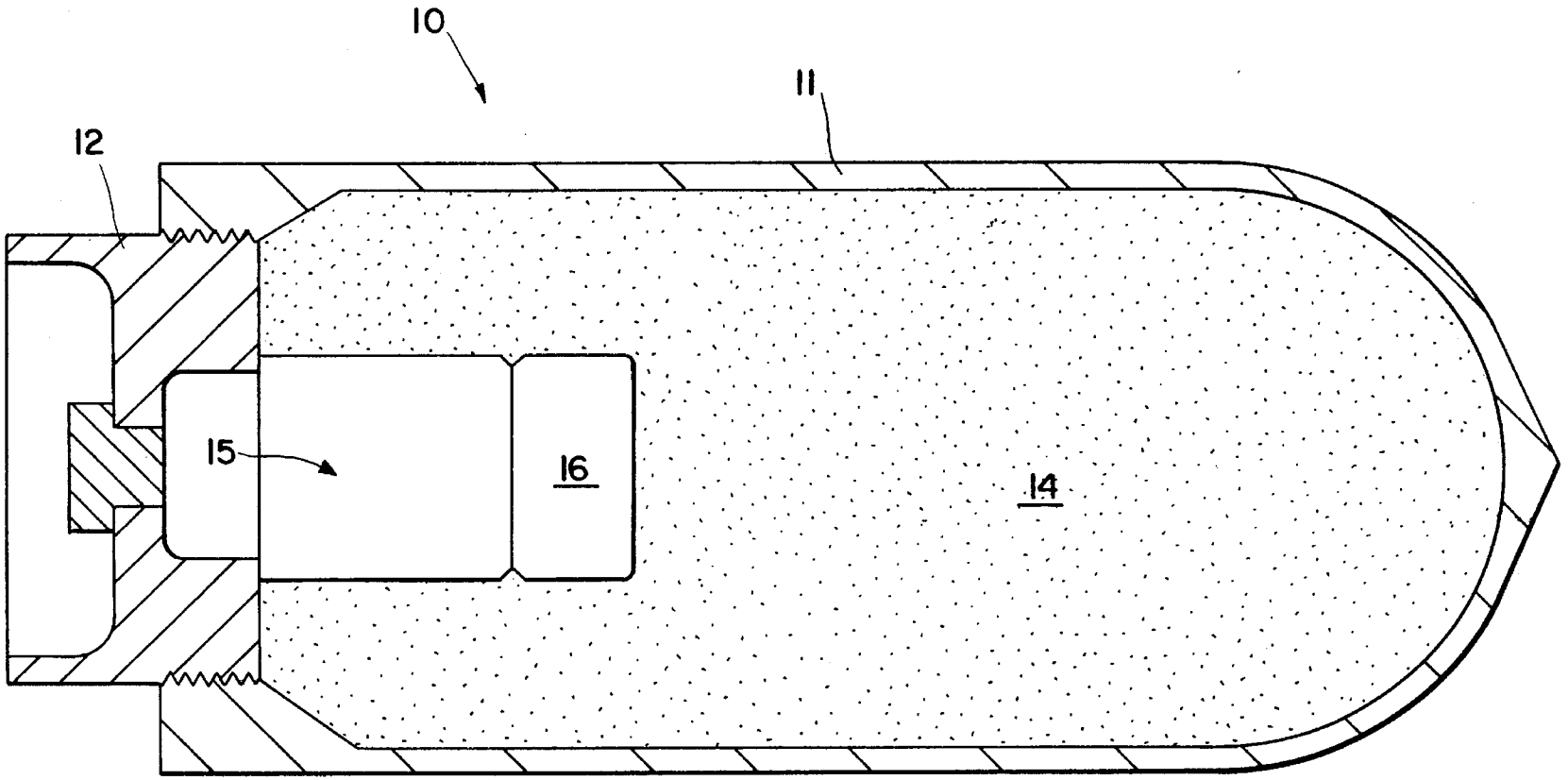
FIG. 1 is a sectional view of the dual mode warhead of the present invention illustrating the principal components thereof.

Attention is now directed to the drawings, wherein like numerals of reference designate like parts throughout the several views, and more particularly to FIG. 1 wherein there is illustrated a dual mode warhead designated generally by the reference numeral 10. The warhead 10 comprises a casing or body 11, which is substantially a right circular cylinder having a hemispheric nose, and a base closure 12. The casing 11 is fabricated of a strong yet ductile material such as aluminum or steel. The strength permits substantial penetration of a soft target with little deformation until detonation by a time delay fuze. The ductility permits the casing to mushroom against a hard target while still confining the explosive charge until detonation by the fast firing train. A conical projection on the hemispheric nose on the casing 11 enhances the aerodynamic and sand penetration characteristics of the dual mode warhead. The base closure 12 is an adapter for connecting the warhead 10 to some propulsion system, e.g., a rocket motor or recoilless rifle launcher, (not shown) or it may be a simple plug depending on the weapons system using the warhead. The casing or body 11 is filled with a structurally stiff explosive charge 14 for transmitting the deceleration shock of target impact to the fuze with minimum attenuation. Composition A-3 with 30% (by weight) powdered aluminum meets this requirement, as well as being an extremely energetic explosive. A fuze assembly, designated generally by the reference numeral 15, is fixed to the base closure 12 and has mounted thereon a booster 16 for detonating the explosive charge 14.

Figure 2:
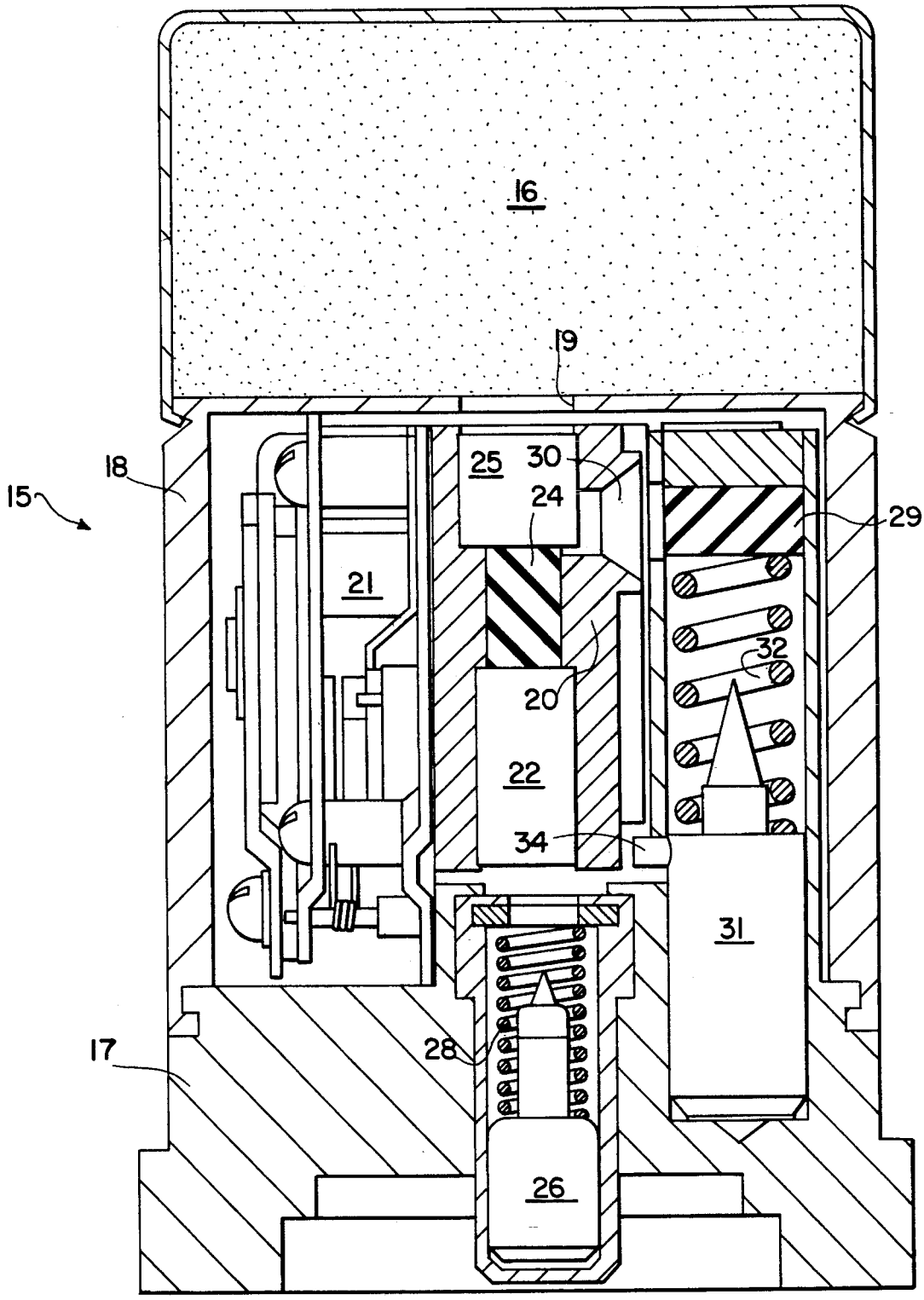
FIG. 2 is a sectional view of the fuzing assembly illustrating the principal features thereof.

Attention is now directed to FIG. 2 wherein the fuze assembly is illustrated in greater detail. The fuze assembly 15 comprises a base plate 17 and a housing 18 mounted thereon. The booster 16 is mounted on the other end of the housing 18 adjacent a port 19 in the housing 18 which permits access of a detonation wave to the booster. A rotor 20 is disposed within the housing 18 and is movable from a safe to an armed position by means of an arming mechanism 21. The arming mechanism 21 may be any of various safing and arming mechanisms well known to those skilled in the art, such as the three leaf mechanism, and will not be described in any further detail. The rotor 20 contains an explosive train comprising a primer 22, a delay element 24, and a detonator 25 which is disposed adjacent the port 19 when the rotor 20 is in the firing position. A low g inertial element 26 is disposed within the base plate 17 in axial alignment with the primer 22 and is normally biased to the position shown in FIG. 2 by a compression spring 28. The elements 22, 24, 25, 26 and 28 comprise the low g firing train and will operate upon warhead impact with soft targets.

A high g primer 29 is provided for initiating detonator 25 by propagation through a blow-thru hole 30 formed in the rotor 20. A high g inertial element 31 is provided for initiating primer 21 and is normally biased to the position shown in FIG. 2 by a high compression spring 32. A shear pin 34 is provided to restrain the inertial element 31 during low g impacts. The elements 25, 29, 31 and 32 comprise the high g firing train and will operate only upon warhead impact with hard targets.

OPERATION

In order that a better understanding of the invention might be had, its modes of operation will now be described.

The dual mode warhead will normally have an impact velocity of approximately 250 to 3,000 ft/sec. If the round impacts a soft target, such as a sandbag-timber or sandbag-concrete bunker, at low velocity the round will penetrate to a depth of 3 to 4 feet. The fuze will sense, by the magnitude of the initial deceleration, that the round has hit a soft target. The sensing is accomplished as follows. Upon the impact, the inertial elements 26 and 31 will be urged forward due to their inertia. The shear pin 34 will, however, restrain the inertial element 31 upon a low g impact whereas the inertial element 26 will move forward compressing the spring 28 and initiating the primer 22. The delay element 24, detonator 25, booster 16 and explosive charge 14 are then successively initiated. The time delay in the low g firing train allows sufficient time for substantial penetration of a soft target prior to detonation of the round. Test firings of dual mode warheads wherein the low g firing train included a 15 to 50 millisecond delay and was initiated by a deceleration of not more than 1,000 g against designated standard sandbag-timber bunkers have demonstrated these warheads to be highly effective.

If the round impacts a hard target, such as a reinforced concrete or masonry target, the casing 11 will crush in a generally mushroom shape. The mushrooming of the casing 11 against a hard target disposes more of the explosive closer to the surface of the target which serves to increase the blast effect when the warhead detonates. This aspect of the operation of the dual mode warhead is similar to that of the prior art high explosive plastic (HEP) rounds. The fuze will sense impact with a hard target, allow sufficient time for crushing or mushrooming, and then detonate the round. Impact with a hard target is sensed as follows. A high g impact will cause the pin 34 to shear, allowing the high g inertial element 31 to compress the spring 32 and initiate the high g primer 29 which will then initiate the detonator 25, through the blow-thru hole 30. The booster 16 and explosive charge 14 are then successively initiated. Upon target impact, the low g firing train will also have been initiated. However, the detonator 25 will have been initiated by the primer 29 well before the delay element 24 has timed out and thus the low g firing train, though initiated, has no effect on the high g operation. Test firings of a dual mode warhead in which the high g firing train functions in about 0.5 milliseconds and is restrained by a shear pin 34 designed to fail under decelerations in excess of 15,000 g have proven the dual mode warhead to be effective against hard targets such as reinforced concrete. Test firings have verified that except at high target impact obliquity (i.e., greater than 45°), the deceleration levels experienced by the warhead upon impact with hard or soft targets are sufficiently different for the shock sensing fuze to function properly. Thus the present invention provides a dual mode warhead which exhibits different characteristics against different targets, Obviously many modifications and variations of the present invention are possible in the light of the above teachings and will readily occur to those skilled in the art. It is therefore to be understood that with the scope of the appended claims the invention may be practiced otherwise than as specifically described.

What is claimed is:

1. A dual mode warhead for use against both soft and hard targets and capable of sensing which type of target has been struck comprising:

a hollow casing formed of a strong ductile material;

a base closure for closing the rearward end of said casing;

a structurally-stiff explosive charge filling the interior of said casing;

a booster disposed within said explosive charge for detonating said explosive; and a shock-sensing fuze assembly mounted on said base closure and carrying said booster for initiating said booster upon impact with a target, said fuze assembly comprising:

a low g inertial firing train responsive to low impact deceleration for initiating said booster upon impact with a soft target, said low g firing train including a time delay element to permit substantial penetration of the target before detonation of said explosive charge; and a high inertial firing train responsive to high impact deceleration for initiating said booster upon impact with a hard target, the ductility of said casing allowing said casing to mushroom without fragmenting immediately upon impact with a hard target thereby disposing more of said explosive charge closer to the surface of said target prior to detonation of said explosive charge whereby the blast effectiveness is increased.

2. A warhead as defined in claim 1 wherein said low g firing train comprises:

a low g inertial element;

a low g compression spring normally biasing said low g inertial element rearwardly;

a low g primer adapted to be initiated by forward movement of said low g inertial element upon soft target impact;

a pyrotechnic delay element initiated by said primer for allowing target penetration; and a detonator fired by said delay element for initiating said booster to detonate said explosive charge.

3. A warhead as defined in claim 1 wherein said high g firing train comprises:

a high g inertial element;

a high g compression spring normally biasing said high g inertial element rearwardly;

a shear pin normally restraining forward movement of said high g inertial element and adapted to shear upon hard target impact;

a high g primer adapted to be initiated by forward movement of said high g inertial element upon hard target impact; and a detonator fired by said primer for initiating said booster to detonate said explosive charge.

4. A warhead as defined in claim 2 wherein said high g firing train comprises:

a high g inertial element;

a high g compression spring normally biasing said high g inertial element rearwardly;

a shear pin normally restraining forward movement of said high g inertial element and adapted to shear upon hard target impact; and a high g primer adapted to be initiated by forward movement of said high g inertial element upon hard target impact for firing said detonator.

5. A warhead as defined in claim 1 wherein said low g firing train incorporates a time delay of approximately 15 to 50 milliseconds and is operable when subjected to an impact deceleration on the order of 100 to 1000 g.

6. A warhead as defined in claim 1 wherein said high g firing train functions in about 0.5 milliseconds and is operable only when subjected to impact decelerations in excess of 15,000 g.

7. A warhead as defined in claim 5 wherein said high g firing train functions in about 0.5 milliseconds and is operable only when subjected to impact decelerations in excess of 15,000 g.

* * * * *